US011566573B2

(12) United States Patent
Ikeda et al.

(10) Patent No.: US 11,566,573 B2
(45) Date of Patent: Jan. 31, 2023

(54) CONTROL APPARATUS FOR INTERNAL COMBUSTION ENGINE

(71) Applicant: TOYOTA JIDOSHA KABUSHIKI KAISHA, Toyota (JP)

(72) Inventors: Yuto Ikeda, Kazaki (JP); Yuki Nose, Nagoya (JP); Takanobu Gotoh, Obu (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/480,314

(22) Filed: Sep. 21, 2021

(65) Prior Publication Data

US 2022/0145816 A1 May 12, 2022

(30) Foreign Application Priority Data

Nov. 11, 2020 (JP) ..... JP2020-188007

(51) Int. Cl.

| | |
|---|---|
| ***F02D 41/02*** | (2006.01) |
| ***F02B 75/18*** | (2006.01) |
| ***F01N 3/021*** | (2006.01) |
| ***F02D 41/40*** | (2006.01) |
| ***F01N 3/20*** | (2006.01) |
| ***F02D 41/00*** | (2006.01) |

(52) U.S. Cl.

CPC ..... *F02D 41/024* (2013.01); *F01N 3/021* (2013.01); *F01N 3/2006* (2013.01); *F02B 75/18* (2013.01); *F02D 41/0087* (2013.01); *F02D 41/40* (2013.01); *F01N 2430/02* (2013.01)

(58) Field of Classification Search

CPC ..... F01N 3/021; F01N 3/035; F01N 3/2006; F01N 2430/02; F01N 2430/06; F02D 41/024; F02D 41/40; F02D 2200/0812; F02D 41/0087; F02D 41/029; F02D 41/1467; F02B 75/18

See application file for complete search history.

(56) References Cited

U.S. PATENT DOCUMENTS

| | | | | |
|---|---|---|---|---|
| 2003/0121249 | A1* | 7/2003 | Foster | F01N 3/0842 60/285 |
| 2014/0000552 | A1* | 1/2014 | Glugla | F02P 17/02 123/295 |
| 2016/0025021 | A1* | 1/2016 | Hilditch | F02M 26/14 60/274 |
| 2020/0025050 | A1* | 1/2020 | Chen | F01N 11/005 |
| 2021/0071608 | A1* | 3/2021 | Martin | F02D 41/1475 |

FOREIGN PATENT DOCUMENTS

JP 2006-22753 A 1/2006

* cited by examiner

*Primary Examiner* — Phutthiwat Wongwian
*Assistant Examiner* — Diem T Tran
(74) *Attorney, Agent, or Firm* — Oblon, McClelland, Maier & Neustadt, L.L.P.

(57) ABSTRACT

When a performance flag of a temperature raising process becomes "1", a CPU increases an injection amount for first, third and fourth cylinders from a base injection amount for making an air-fuel ratio of an air-fuel mixture equal to a theoretical air-fuel ratio, by an increase amount, and stops combustion control in a second cylinder. The CPU gradually increases a ratio of the increase amount to the base injection amount, at the start of the temperature raising process.

6 Claims, 4 Drawing Sheets

CONTROL APPARATUS FOR INTERNAL COMBUSTION ENGINE

CROSS-REFERENCE TO RELATED APPLICATION

This application claims priority to Japanese Patent Application No. 2020-188007 filed on Nov. 11, 2020, incorporated herein by reference in its entirety.

BACKGROUND

1. Technical Field

The present disclosure relates to a control apparatus for an internal combustion engine.

2. Description of Related Art

For example, in Japanese Unexamined Patent Application Publication No. 2006-22753 (JP 2006-22753 A), there is described an apparatus that makes an air-fuel ratio temporarily rich and then lean when a temperature raising process for a catalyst is performed for a regeneration process of the catalyst.

SUMMARY

In the case where a large amount of fuel flows into the catalyst in response to the start of the foregoing temperature raising process, the catalyst may crack due to thermal stress, as a result of a rapid rise in temperature of the catalyst.

Means for solving the aforementioned problem and the operation and effects thereof will be described hereinafter.

1. A control apparatus for an internal combustion engine is applied to a multi-cylinder internal combustion engine equipped with a post-processing device in an exhaust passage. The post-processing device includes a catalyst. The control apparatus for the internal combustion engine includes a processor. The processor is configured to perform a temperature raising process of the catalyst. The temperature raising process includes a stop process for stopping combustion control in one or some of a plurality of cylinders, and a rich combustion process for making an air-fuel ratio of an air-fuel mixture richer than a theoretical air-fuel ratio in the cylinder or cylinders different from the one or some of the cylinders. The processor is configured to perform a gradual increase process for gradually increasing a degree of richness of the air-fuel mixture resulting from the rich combustion process, from the start of the temperature raising process.

In the foregoing configuration, when the temperature raising process is started, the degree of richness of the air-fuel ratio of the air-fuel mixture resulting from the rich combustion process is gradually increased through the gradual increase process. Therefore, the speed of increase in thermal energy resulting from the oxidation of unburnt fuel in the catalyst per unit time upon the raising of the temperature can be made lower than in the case where the gradual increase process is not performed. When the speed of increase in thermal energy can be lowered, the speed of rise in the temperature of the catalyst can be held low. In the foregoing configuration, therefore, the catalyst can be restrained from cracking.

2. The control apparatus for the internal combustion engine mentioned above in 1 may be configured as follows. The post-processing device includes a filter that is configured to collect particulate matter in exhaust gas. The processor is configured to perform a determination process for determining that there is a demand to perform the temperature raising process as soon as an amount of the particulate matter collected by the filter becomes equal to or larger than a threshold. The temperature raising process is a process that is performed when it is determined through the determination process that the demand to perform the temperature raising process exists, and an operating state of the internal combustion engine fulfills a predetermined condition, and that is completed when the amount of the particulate matter becomes equal to or smaller than a predetermined amount. A timing when the gradual increase process is performed at the start of the temperature raising process includes a timing when the temperature raising process is resumed as a result of re-fulfilment of the predetermined condition after the predetermined condition fails to be fulfilled during the performance of the temperature raising process.

In the foregoing configuration, the gradual increase process is performed even when the temperature raising process is resumed. Thus, even when the temperature of the catalyst falls while the temperature raising process is interrupted, it is possible to restrain the temperature of the catalyst from rapidly rising in response to the resumption of the temperature raising process.

3. The control apparatus for the internal combustion engine mentioned above in 1 or 2 may be configured as follows. The gradual increase process includes a process for making the air-fuel ratio of the air-fuel mixture resulting from the rich combustion process that is performed after the stop process, richer than the air-fuel ratio of the air-fuel mixture resulting from the rich combustion process that is performed before the stop process, with the rich combustion process being performed a pair of times across the stop process.

In the foregoing configuration, the air-fuel ratio is changed from a value before the stop process to a value after the stop process. Thus, the speed of increase in the degree of richness can be made equal to or higher than the amount of decrease in the air-fuel ratio of the air-fuel mixture during the interval between the timings when the rich combustion process is performed a pair of times across the stop process.

4. The control apparatus for the internal combustion engine mentioned above in 3 may be configured as follows. The temperature raising process includes two processes, namely, the stop process and the rich combustion process in each combustion cycle. In the foregoing configuration, each combustion cycle includes two processes, namely, the stop process and the rich combustion process. Thus, the amount of fuel can be increased at least once in one combustion cycle.

5. The control apparatus for the internal combustion engine mentioned above in any one of 1 to 4 may be configured as follows. The rich combustion process includes an increase rate setting process for calculating a fuel increase rate for a fuel amount corresponding to the theoretical air-fuel ratio. The gradual increase process includes a process for setting a fuel injection amount in the different cylinder or cylinders in accordance with a smaller one of a value obtained by adding a prescribed amount to a fuel increase rate that determines a last degree of richness and the fuel increase rate set through the increase rate setting process.

In the foregoing configuration, the speed of increase in the fuel increase rate is regulated by the prescribed amount. Thus, the adaptation man-hour needed to set the prescribed amount can be made smaller than in the case where the amount of increase is regulated by the prescribed amount. That is, when the amount of injection greatly fluctuates in accordance with the magnitude of the filling efficiency of the internal combustion engine, the appropriate amount of increase also fluctuates greatly. In contrast, the amount of fluctuation in the appropriate fuel increase rate is smaller than the amount of fluctuation in the appropriate amount of increase.

6. The control apparatus for the internal combustion engine mentioned above in any one of 1 to 5 may be configured as follows. The gradual increase process is a process for updating the degree of richness at intervals of one combustion cycle. In the foregoing configuration, the update cycle of the degree of richness can be made longer than the interval between temporally adjacent combustion cycles in each of the cylinders in which combustion control is continued. Thus, the adjustment of the degree of richness can be restrained from becoming excessively fine. A minute injection amount has a small magnitude relative to an error resulting from individual differences and the like among fuel injection valves, and hence is more likely to enhance the SN ratio of the injection amount in the foregoing configuration than in the case where the degree of richness is finely adjusted.

BRIEF DESCRIPTION OF THE DRAWINGS

Features, advantages, and technical and industrial significance of exemplary embodiments of the present disclosure will be described below with reference to the accompanying drawings, in which like signs denote like elements, and wherein.

DETAILED DESCRIPTION OF EMBODIMENTS

One of the embodiments will be described hereinafter with reference to the drawings.

Figure 1:
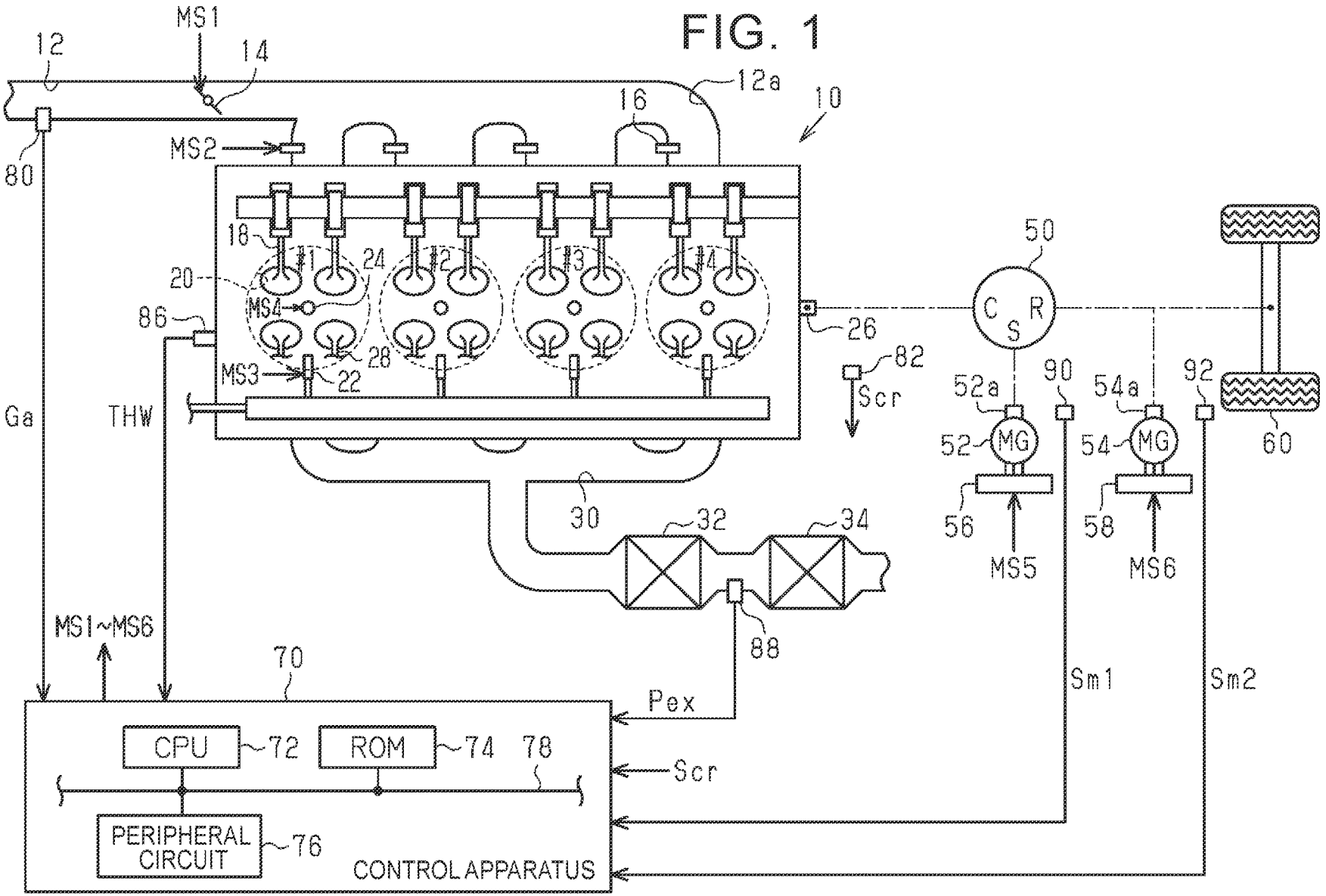
FIG. 1 is a view showing the configuration of a control apparatus and a drive train according to the first embodiment.

As shown in FIG. 1, an internal combustion engine 10 is equipped with four cylinders #1 to #4. A throttle valve 14 is provided in an intake passage 12 of the internal combustion engine 10. Intake ports 12*a* that constitute downstream regions of the intake passage 12 are provided with port injection valves 16 that inject fuel into the intake ports 12*a*, respectively. The air sucked into the intake passage 12 and the fuel injected from the port injection valves 16 flow into combustion chambers 20 as intake valves 18 are opened, respectively. Fuel is injected from in-cylinder injection valves 22 into the combustion chambers 20 respectively. Besides, the air-fuel mixture in the combustion chambers 20 is burned in response to spark discharge by ignition plugs 24 respectively. The combustion energy produced at this time is converted into rotational energy of a crankshaft 26.

The air-fuel mixture burned in the combustion chambers 20 is discharged to an exhaust passage 30 as exhaust gas, as exhaust valves 28 are opened, respectively. The exhaust passage 30 is provided with a three-way catalyst 32 capable of occluding oxygen, and a gasoline particulate filter (GPF) 34. The GPF 34 is constituted of a filter for collecting particulate matter (PM), and a three-way catalyst capable of occluding oxygen and carried on the filter.

The crankshaft 26 is mechanically coupled to a carrier C of a planetary gear mechanism 50 constituting a motive power split device. A rotary shaft 52*a* of a first motor-generator 52 is mechanically coupled to a sun gear S of the planetary gear mechanism 50. Besides, a rotary shaft 54*a* of a second motor-generator 54 and driving wheels 60 are mechanically coupled to a ring gear R of the planetary gear mechanism 50. An inverter 56 applies an AC voltage to a terminal of the first motor-generator 52. Besides, an inverter 58 applies an AC voltage to a terminal of the second motor-generator 54.

A control apparatus 70 is designed to control the internal combustion engine 10, and operates operating units of the internal combustion engine 10 such as the throttle valve 14, the port injection valves 16, the in-cylinder injection valves 22, and the ignition plugs 24 to control a torque, an exhaust gas component ratio, and the like as controlled variables of the internal combustion engine 10. Besides, the control apparatus 70 is designed to control the first motor-generator 52, and operates the inverter 56 to control a rotational speed that is a controlled variable of the first motor-generator 52. Besides, the control apparatus 70 is designed to control the second motor-generator 54, and operates the inverter 58 to control a torque that is a controlled variable of the second motor-generator 54. In FIG. 1, operation signals MS1 to MS6 for the throttle valve 14, the port injection valves 16, the in-cylinder injection valves 22, the ignition plugs 24, and the inverters 56 and 58 are depicted. In order to control the controlled variables of the internal combustion engine 10, the control apparatus 70 refers to an intake air amount Ga detected by an airflow meter 80, an output signal Scr of a crank angle sensor 82, a coolant temperature THW detected by a coolant temperature sensor 86, and a pressure Pex of exhaust gas flowing into the GPF 34 that is detected by an exhaust gas pressure sensor 88. Besides, in order to control the controlled variables of the first motor-generator 52 and the second motor-generator 54, the control apparatus 70 refers to an output signal Sm1 of a first rotational angle sensor 90 that detects a rotational angle of the first motor-generator 52, and an output signal Sm2 of a second rotational angle sensor 92 that detects a rotational angle of the second motor-generator 54.

The control apparatus 70 is equipped with a CPU 72 as a processor, a ROM 74, and a peripheral circuit 76, which can communicate with one another through a communication line 78. It should be noted herein that the peripheral circuit 76 includes a circuit for generating a clock signal prescribing internal operation, an electric power supply circuit, a reset circuit, and the like. The control apparatus 70 controls the controlled variables through the execution of a program stored in the ROM 74 by the CPU 72.

Figure 2:
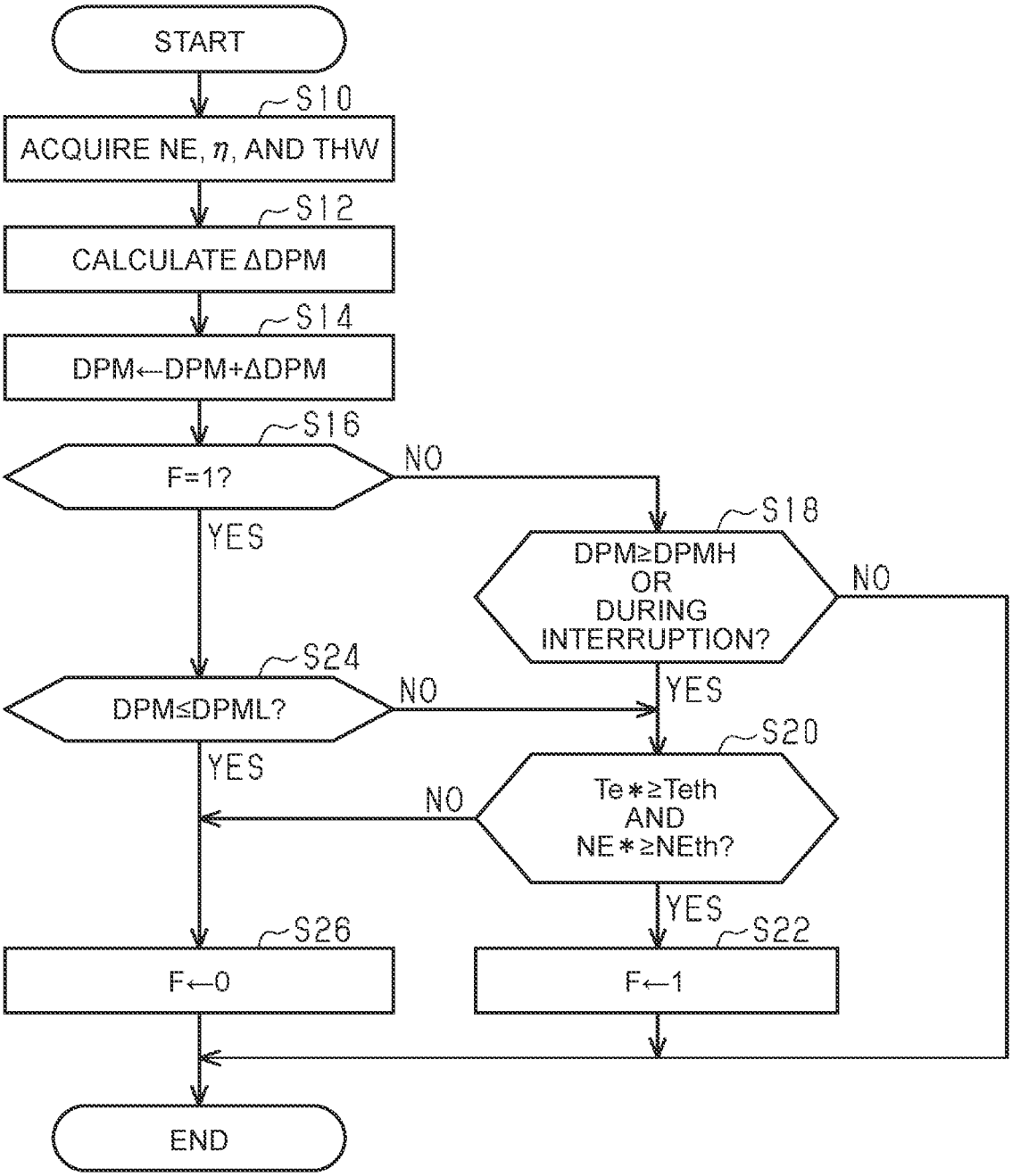
FIG. 2 is a flowchart showing the procedure of processes that are performed by the control apparatus according to the embodiment.

FIG. 2 shows the procedure of processes that are performed by the control apparatus 70 according to the present embodiment. The processes shown in FIG. 2 are realized through the repeated execution of the program stored in the ROM 74 by the CPU 72, for example, on a predetermined cycle. Incidentally, a step number of each of the processes is denoted by a number preceded by "S".

In the series of processes shown in FIG. 2, the CPU 72 first acquires a rotational speed NE, a filling efficiency η, and a coolant temperature THW (S10). The rotational speed NE is calculated based on the output signal Scr by the CPU 72. Besides, the filling efficiency η is calculated based on the intake air amount Ga and the rotational speed NE by the CPU 72. Subsequently, the CPU 72 calculates an update amount ΔDPM of a deposition amount DPM, based on the rotational speed NE, the filling efficiency η, and the coolant temperature THW (S12). It should be noted herein that the deposition amount DPM is an amount of PM collected by the GPF 34. More specifically, the CPU 72 calculates an amount of PM in exhaust gas discharged to the exhaust passage 30, based on the rotational speed NE, the filling efficiency η, and the coolant temperature THW. Besides, the CPU 72 calculates a temperature of the GPF 34 based on the rotational speed NE and the filling efficiency η. The CPU 72 then calculates the update amount ΔDPM based on the amount of PM in exhaust gas and the temperature of the GPF 34. Incidentally, in performing the process of S36 that will be described later, the update amount ΔDPM may be calculated based on the filling efficiency η and an increase coefficient K, in the process of S12.

Subsequently, the CPU 72 updates the deposition amount DPM in accordance with the update amount ΔDPM (S14). Subsequently, the CPU 72 determines whether or not a performance flag F is "1" (S16). When being "1", the performance flag F indicates that a temperature raising process for removing the PM in the GPF 34 through combustion is performed. When being "0", the performance flag F indicates that the temperature raising process is not performed. If it is determined that the performance flag F is "0" (NO in S16), the CPU 72 determines whether or not a logical sum of that the deposition amount DPM is equal to or larger than a regeneration performance value DPMH and that the process of S36 that will be described later is interrupted is true (S18). It should be noted herein that the regeneration performance value DPMH is set as a value at which the removal of PM is desired because the amount of PM collected by the GPF 34 is large.

If it is determined that the logical sum is true (YES in S18), the CPU 72 determines whether or not a logical product of conditions (i) and (ii) shown below that are conditions for performing the temperature raising process is true (S20).

The condition (i) is that an engine torque command value Te* that is a command value of a torque for the internal combustion engine 10 is equal to or larger than a predetermined value Teth. The condition (ii) is a condition that the rotational speed NE of the internal combustion engine 10 is equal to or higher than a predetermined speed NEth.

If it is determined that the logical product is true (YES in S20), the CPU 72 assigns "1" to the performance flag F (S22). On the other hand, if it is determined that the performance flag F is "1" (YES in S16), the CPU 72 determines whether or not the deposition amount DPM is equal to or smaller than a stop threshold DPML (S24). The stop threshold DPML is set as a value at which a regeneration process may be stopped because the amount of PM collected by the GPF 34 has become sufficiently small. If the deposition amount DPM is equal to or smaller than the stop threshold DPML (YES in S24) or if the result of the determination in the process of S20 is negative, the CPU 72 assigns "0" to the performance flag F (S26).

Figure 3:
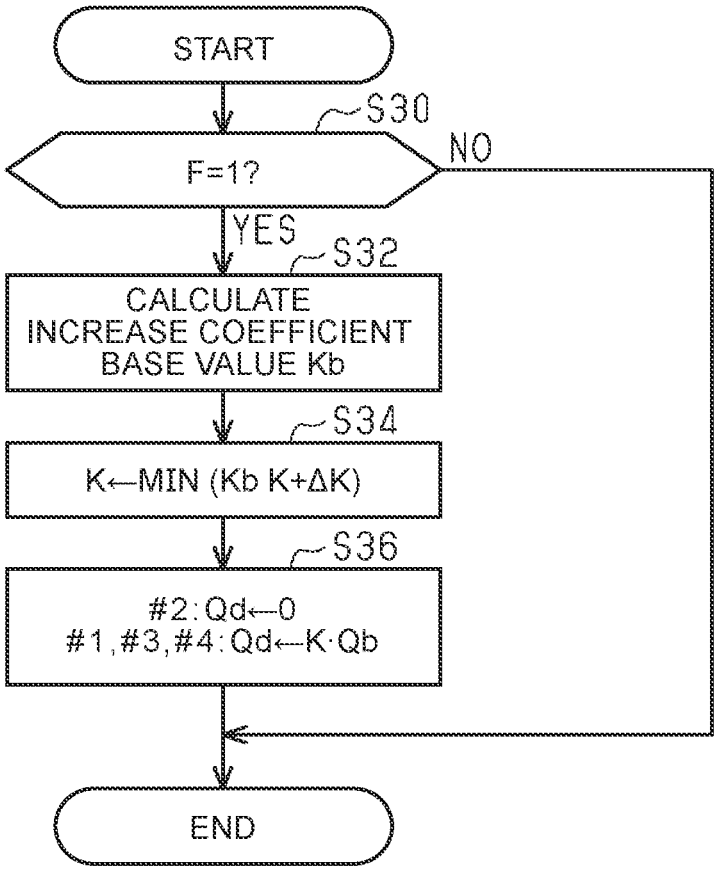
FIG. 3 is a flowchart showing the procedure of processes that are performed by the control apparatus according to the embodiment.

Incidentally, in completing the process of S22 and S26 or determining that the result is negative in the process of S18, the CPU 72 temporarily ends the series of processes shown in FIG. 2. FIG. 3 shows the procedure of processes that are performed by the control apparatus 70 according to the present embodiment. The processes shown in FIG. 3 are realized through the repeated execution of the program stored in the ROM 74 by the CPU 72 at intervals of one combustion cycle.

In the series of processes shown in FIG. 3, the CPU 72 first determines whether or not the performance flag F is "1" (S30). If it is determined that the performance flag F is "1" (YES in S30), the CPU 72 calculates an increase coefficient base value Kb (S32). In the present embodiment, the increase coefficient base value Kb is a value determined in advance at the beginning of the temperature raising process. Subsequently, the CPU 72 assigns the smaller one of the increase coefficient base value Kb and a value obtained by adding a prescribed amount ΔK to the increase coefficient K to the increase coefficient K (S34). This process is designed to adopt an upper limit of an amount of increase in the increase coefficient K per combustion cycle as the prescribed amount ΔK.

The CPU 72 then performs the temperature raising process based on the increase coefficient K (S36). More specifically, the CPU 72 stops injection of fuel from the port injection valve 16 and the in-cylinder injection valve 22 of the cylinder #2, and makes the air-fuel ratio of the air-fuel mixture in the combustion chambers 20 of the cylinders #1, #3, and #4 richer than the theoretical air-fuel ratio. First of all, this process is designed to raise the temperature of the three-way catalyst 32. That is, unburnt fuel is oxidized in the three-way catalyst 32 to raise the temperature of the three-way catalyst 32, by discharging oxygen and unburnt fuel to the exhaust passage 30. Secondly, this process is designed to raise the temperature of the GPF 34, supply oxygen to the GPF 34 that has reached a high temperature, and remove the PM collected by the GPF 34 through oxidation. That is, when the temperature of the three-way catalyst 32 becomes high, the temperature of the GPF 34 rises due to the flow of high-temperature exhaust gas into the GPF 34. Then, the PM collected by the GPF 34 is removed through oxidation through the flow of oxygen into the GPF 34 that has reached a high temperature.

More specifically, the CPU 72 assigns "0" to a required injection amount Qd for the port injection valve 16 and the in-cylinder injection valve 22 of the cylinder #2. On the other hand, the CPU 72 assigns a value obtained by multiplying a base injection amount Qb that is an injection amount for making the air-fuel ratio of the air-fuel mixture equal to the theoretical air-fuel ratio by the increase coefficient K, to the required injection amount Qd for the cylinders #1, #3, and #4.

The increase coefficient base value Kb is set such that the air-fuel ratio of the air-fuel mixture in the cylinders #1, #3, and #4 ensures that the amount of unburnt fuel in exhaust gas discharged to the exhaust passage 30 from the cylinders #1, #3, and #4 becomes equal to or smaller than such an amount as to react with the oxygen discharged from the cylinder #2 in just proportion. More specifically, at the beginning of the regeneration process of the GPF 34, the air-fuel ratio of the air-fuel mixture in the cylinders #1, #3, and #4 is made as close as possible to the value that makes the unburnt fuel react with the oxygen in just proportion, so as to raise the temperature of the three-way catalyst 32 at an early stage. In contrast, after the temperature of the GPF 34 has risen, the air-fuel ratio of the air-fuel mixture in the cylinders #1, #3, and #4 is made smaller than the value that makes the unburnt fuel react with the oxygen in just proportion, so as to supply oxygen to the GPF 34.

Incidentally, in completing the process of S36 or determining that the result is negative in the process of S30, the CPU 72 temporarily ends the series of processes shown in FIG. 3. Incidentally, if the result of the determination in the process of S30 is negative, the process of S36 is not performed. Therefore, if the result of the determination in the process of S24 is positive, the process of S36 is stopped. Besides, if the result of the determination in the process of S20 is negative while the performance flag F is "1", the process of S36 is interrupted.

Figure 4:
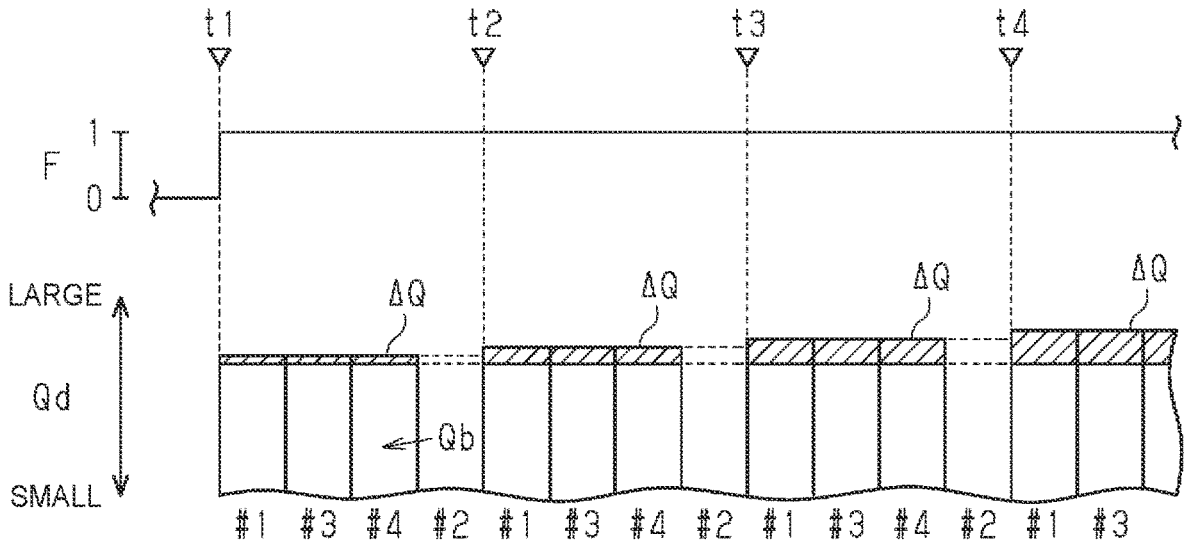
FIG. 4 is a time chart exemplifying a gradual increase process for increasing an injection amount at the start of a temperature raising process in the embodiment.

The operation and effects of the present embodiment will now be described. FIG. 4 exemplifies the start of the temperature raising process according to the present embodiment. As shown in FIG. 4, when the temperature raising process is started at a timing t1, the increase amount ΔQ that is an amount larger than the base injection amount Qb, as part of the required injection amount Qd is increased at intervals of one combustion cycle. This is realized through gradual increase in the increase coefficient K at intervals of one combustion cycle by the CPU 72. In FIG. 4, each of a time between the timing t1 and a timing t2, a time between the timing t2 and a timing t3, and a time between the timing t3 and a timing t4 corresponds to one combustion cycle. It should be noted herein that the increase amount ΔQ is determined as "(K−1)·Qb", and gradually increases as the increase coefficient K gradually increases. To be more precise, the ratio of the increase amount ΔQ to the base injection amount Qb gradually increases at intervals of one combustion cycle. Thus, after the start of the temperature raising process, the air-fuel ratio of the air-fuel mixture in the cylinders #1, #3, and #4 becomes richer than the theoretical air-fuel ratio, and the degree of richness gradually increases. Thus, the amount of oxidation heat in oxidizing unburnt fuel in the three-way catalyst 32 gradually increases, and the amount of thermal energy contributing towards raising the temperature of the three-way catalyst 32 gradually increases.

Figure 5:
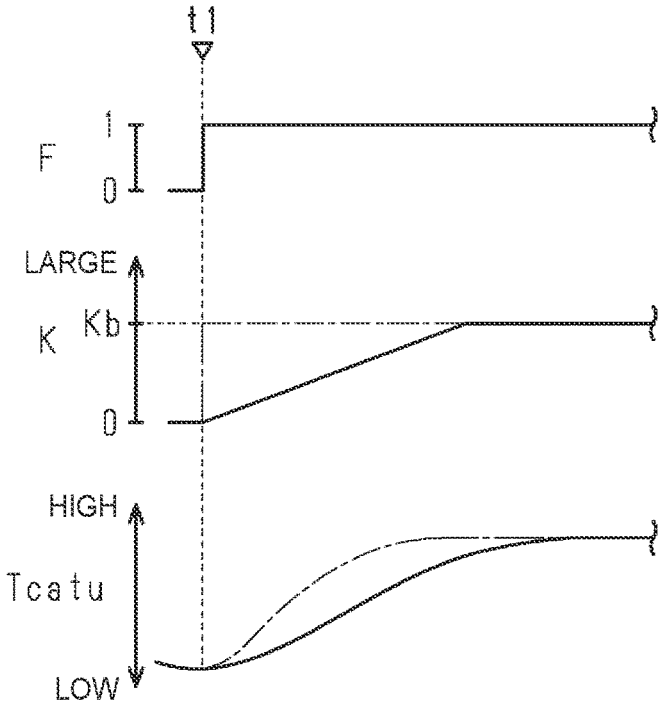
FIG. 5 is a time chart showing an effect of the embodiment.

FIG. 5 shows how the performance flag F, the increase coefficient K, and a temperature Tcatu of the three-way catalyst 32 change. In FIG. 5, solid lines indicate how the increase coefficient K and the temperature Tcatu according to the present embodiment change respectively, and alternate long and short dash lines indicate how the increase coefficient K and the temperature Tcatu in a comparative example change respectively. In the comparative example, the increase coefficient K is changed to the increase coefficient base value Kb without being increased gradually. As shown in FIG. 5, in the present embodiment, the speed of rise in the temperature Tcatu can be restrained from becoming excessively high, by gradually increasing the increase coefficient K. Therefore, the three-way catalyst 32 can be restrained from cracking.

In contrast, in the comparative example, the increase coefficient K is raised straight to the increase coefficient base value Kb as the temperature raising process is started. Thus, the speed of rise in the temperature Tcatu of the three-way catalyst 32 may become excessively high.

Furthermore, the operation and effects mentioned below are obtained from the present embodiment described above.

(1) The CPU 72 performs the processing of S34 when the performance flag F is "1". Thus, even in the case where the deposition amount DPM has not become equal to or smaller than the stop threshold DPML yet after the start of the temperature raising process, and the temperature raising process is interrupted and then resumed with the PM regeneration process of the GPF 34 not completed, the CPU 72 gradually increases the increase coefficient K. Thus, even when the temperature of the three-way catalyst 32 falls while the temperature raising process is interrupted, it is possible to restrain the temperature of the three-way catalyst 32 from rapidly rising as a result of the resumption of the temperature raising process.

(2) The CPU 72 assigns the smaller one of the value obtained by adding the prescribed amount ΔK to the increase coefficient K and the increase coefficient base value Kb, to the increase coefficient K. Thus, the adaptation man-hour needed to set the prescribed amount can be made smaller than in the case where the amount of increase in the base injection amount Qb is regulated by the prescribed amount. That is, when the base injection amount Qb greatly fluctuates in accordance with the magnitude of the filling efficiency of the internal combustion engine, the appropriate amount of increase also fluctuates greatly. In contrast, the amount of fluctuation in the appropriate increase coefficient is smaller than the amount of fluctuation in the appropriate amount of increase.

(3) The increase coefficient K is updated at intervals of one combustion cycle. Thus, the update cycle of the increase coefficient K can be made longer than in the case where the increase coefficient K is updated at intervals of a period between temporally adjacent combustion strokes of the cylinders in which combustion control is continued, so the adjustment of the increase coefficient K can be restrained from becoming excessively fine. A minute injection amount has a small magnitude relative to an error resulting from individual differences and the like among the port injection valves 16 and the in-cylinder injection valves 22, and hence is more likely to enhance the SN ratio of the injection amount in the present embodiment than in the case where the increase coefficient K is finely adjusted.

(Corresponding Relationship)

A corresponding relationship between the items in the foregoing embodiment and the items mentioned in the foregoing section of "means for solving the problem" is as follows. The corresponding relationship will be presented hereinafter for each of the numbers of means for solution mentioned in the section of "means for solving the problem". [1] The post-processing device corresponds to the three-way catalyst 32 and the GPF 34. The catalyst corresponds to the three-way catalyst 32. The temperature raising process corresponds to the process of S36. The gradual increase process corresponds to the process of S34. [2] The filter corresponds to the GPF 34. The determination process corresponds to the process of S18. The timing of resumption of the temperature raising process corresponds to the timing when the performance flag F becomes "1" after becoming "0" as a result of a negative determination in the process of S20 although the result of the determination in the process of S24 is negative after the performance flag F becomes "1". [3, 4, 6] This corresponds to the processes exemplified in FIG. 4. [5] The increase rate setting process corresponds to the process of S34.

(Other Embodiments)

Incidentally, the present embodiment can be carried out after being modified as follows. The present embodiment and the following modification examples can be carried out in combination with one another within such a range that no technical contradiction occurs.

(As for Temperature Raising Process)

In the process of S36, combustion control is stopped only in one of the cylinders in one combustion cycle, but the applicable embodiment is not limited thereto. For example, combustion control may be stopped in two of the cylinders in one combustion cycle.

In the foregoing embodiment, combustion control is stopped in a predetermined one of the cylinders in each combustion cycle, but the applicable embodiment is not limited thereto. For example, the cylinder in which combustion control is stopped may be replaced with another cylinder at intervals of a predetermined cycle.

The temperature raising process may not necessarily be performed at intervals of one combustion cycle. For example, in the case where there are four cylinders as in the foregoing embodiment, one of the cylinders in which combustion control is performed may be selected for each cycle that is five times as long as an interval at which a compression top dead center emerges. Thus, the cylinder in which combustion control is stopped can be replaced cyclically.

(As for Condition for Performing Temperature Raising Process)

In the foregoing embodiment, the foregoing conditions (i) and (ii) are exemplified as the predetermined condition for performing the temperature raising process when a demand to perform the temperature raising process is created. However, the predetermined condition is not limited to the conditions (i) and (ii). For example, the predetermined condition may include only one of the two conditions (i) and (ii).

(As for Gradual Increase Process)

In the foregoing embodiment, the process for increasing the increase coefficient K at intervals of one combustion cycle is not indispensable. For example, the gradual increase process may be a process for increasing the increase coefficient K every time single fuel injection is completed in each of the cylinders in which combustion control is performed. This is especially effective when the temperature raising process is performed at low rotational speed with the condition (ii) excluded from the performance condition as mentioned in, for example, the section of "as for performance condition". Besides, as mentioned in, for example, the section of "as for temperature raising process", this may be a process for increasing the increase coefficient K at intervals of a period that is five times as long as the interval at which the compression top dead center emerges, in the case where combustion control is stopped in one of the cylinders on a cycle corresponding to this period.

In the foregoing embodiment, the increase coefficient K is updated based on the smaller one of the increase coefficient base value Kb and the value obtained by adding the prescribed amount ΔK to the last increase coefficient K, but the applicable embodiment is not limited thereto. For example, at the start of the temperature raising process, the increase coefficient K may be calculated as a value obtained by multiplying the number of times of rotation of the crankshaft 26 since the start of the temperature raising process by a proportional coefficient.

In the foregoing embodiment, the prescribed amount ΔK is a fixed value, but the applicable embodiment is not limited thereto. For example, the prescribed amount ΔK may be variably set in accordance with at least one of two values, namely, the rotational speed NE and the filling efficiency η.

The gradual increase process may not necessarily be designed to gradually increase the increase coefficient K. For example, the gradual increase process may be a process for calculating the increase amount itself and selecting the smaller one of the base value of the increase amount and the value obtained by adding the prescribed amount to the last increase amount when the temperature raising process is performed.

In the foregoing embodiment, the gradual increase process is invariably performed at the start of and upon resumption of the temperature raising process, but the applicable embodiment is not limited thereto. For example, in the case where the temperature raising process is resumed after being temporarily interrupted due to the unfulfillment of the performance condition during the performance of the temperature raising process, the gradual increase process may be performed as long as the time of interruption is equal to or longer than a prescribed time.

"As for Estimation of Deposition Amount"

The process for estimating the deposition amount DPM is not limited to the one exemplified in FIG. 2. For example, the deposition amount DPM may be estimated based on a difference in pressure between regions upstream and downstream of the GPF 34 and the intake air amount Ga. In concrete terms, the deposition amount DPM may be estimated as a value that is larger when the difference in pressure is large than when the difference in pressure is small, and the deposition amount DPM may be estimated as a value that is larger when the intake air amount Ga is small than when the intake air amount Ga is large, even in the case where the difference in pressure remains unchanged. It should be noted herein that the pressure Pex can be used instead of the difference in pressure when the pressure downstream of the GPF 34 is regarded as a constant value.

"As for Post-Processing Device"

The post-processing device may not necessarily be equipped with the GPF 34 downstream of the three-way catalyst 32. For example, the post-processing device may be equipped with the three-way catalyst 32 downstream of the GPF 34. Besides, the post-processing device may not necessarily be equipped with the three-way catalyst 32 and the GPF 34. For example, the post-processing device may be equipped with only the GPF 34. Besides, for example, even in the case where the post-processing device is constituted only of the three-way catalyst 32, if the temperature of the post-processing device needs to be raised at the time of the regeneration process thereof, it is effective to perform the processes exemplified in the foregoing embodiment and the modification examples thereof. Incidentally, in the case where the post-processing device is equipped with the three-way catalyst 32 and the GPF, the GPF may be a simple filter instead of a filter having a three-way catalyst carried thereon.

(As for Control Apparatus)

The control apparatus may not necessarily be equipped with the CPU 72 and the ROM 74 to perform software processes. For example, the control apparatus may be equipped with a dedicated hardware circuit such as an ASIC that subjects at least one or some of the values processed through software to hardware processes. That is, the control apparatus may be configured as mentioned in one of (a) to (c) shown below. (a) The control apparatus is equipped with a processing device that performs all the foregoing processes in accordance with a program, and a program storage device such as a ROM that stores the program. (b) The control apparatus is equipped with a processing device that performs one or some of the foregoing processes in accordance with a program, a program storage device, and a dedicated hardware circuit that performs the other processes. (c) The control apparatus is equipped with a dedicated hardware circuit that performs all the foregoing processes. It should be noted herein that the control apparatus may be equipped with a plurality of software execution devices equipped with processing devices and program storage devices, and/or a plurality of dedicated hardware circuits.

(As for Vehicle)

The vehicle may not necessarily be a series parallel hybrid vehicle, but may be, for example, a parallel hybrid vehicle or a series hybrid vehicle. As a matter of course, the vehicle may not necessarily be a hybrid vehicle, but may be a vehicle in which only the internal combustion engine 10 serves as a motive power generation device.

What is claimed is:

1. A control apparatus for an internal combustion engine, the control apparatus being applied to a multi-cylinder internal combustion engine equipped with a post-processing device in an exhaust passage, the post-processing device includes a catalyst and a filter, the control apparatus for the internal combustion engine comprising a processor configured to:

perform a temperature raising process of the catalyst, the temperature raising process includes a stop process for stopping combustion control in one or some of a plurality of cylinders and supplying oxygen to the exhaust passage from the one or some of the plurality of cylinders in which combustion control is stopped, and a rich combustion process for making an air-fuel ratio of an air-fuel mixture richer than a theoretical air-fuel ratio in the cylinder or cylinders different from the one or some of the cylinders; and perform a gradual increase process for gradually increasing a degree of richness of the air-fuel mixture resulting from the rich combustion process, from start of the temperature raising process, wherein the rich combustion process includes an increase rate setting process for calculating a fuel increase rate for a fuel amount corresponding to the theoretical air-fuel ratio, and the gradual increase process includes a process for setting a fuel injection amount in the cylinder or cylinders different from the one or some of the cylinders in accordance with a smaller one of a value obtained by adding a prescribed amount to a fuel increase rate that determines a last degree of richness and the fuel increase rate set through the increase rate setting process.

2. The control apparatus for the internal combustion engine according to claim 1, wherein the filter of post-processing device is configured to collect particulate matter in the exhaust gas, and the processor is configured to perform a determination process of determining that there is a demand to perform the temperature raising process when an amount of the particulate matter collected by the filter becomes equal to or larger than a threshold, the temperature raising process is a process that is performed when it is determined through the determination process that the demand to perform the temperature raising process exists, and an operating state of the internal combustion engine fulfills a predetermined condition, and that is completed when the amount of the particulate matter becomes equal to or smaller than a predetermined amount, and a timing when the gradual increase process is performed at start of the temperature raising process includes a timing when the temperature raising process is resumed as a result of re-fulfilment of the predetermined condition after the predetermined condition fails to be fulfilled during performance of the temperature raising process.

3. The control apparatus for the internal combustion engine according to claim 1, wherein the gradual increase process includes a process for making the air-fuel ratio of the air-fuel mixture resulting from the rich combustion process that is performed after the stop process, richer than the air-fuel ratio of the air-fuel mixture resulting from the rich combustion process that is performed before the stop process, with the rich combustion process being performed a pair of times across the stop process.

4. The control apparatus for the internal combustion engine according to claim 3, wherein the temperature raising process includes two processes, namely, the stop process and the rich combustion process in each combustion cycle.

5. The control apparatus for the internal combustion engine according to claim 1, wherein the gradual increase process is a process for updating the degree of richness at intervals of one combustion cycle.

6. A control apparatus for an internal combustion engine, the control apparatus being applied to a multi-cylinder internal combustion engine equipped with a post-processing device in an exhaust passage, the post-processing device includes a catalyst, the control apparatus for the internal combustion engine comprising a processor configured to:

perform a temperature raising process of the catalyst, the temperature raising process includes a stop process for stopping combustion control in one or some of a plurality of cylinders, and a rich combustion process for making an air-fuel ratio of an air-fuel mixture richer than a theoretical air-fuel ratio in the cylinder or cylinders different from the one or some of the cylinders; and perform a gradual increase process for gradually increasing a degree of richness of the air-fuel mixture resulting from the rich combustion process, from start of the temperature raising process, wherein:

the rich combustion process includes an increase rate setting process for calculating a fuel increase rate for a fuel amount corresponding to the theoretical air-fuel ratio, and the gradual increase process includes a process for setting a fuel injection amount in the cylinder or cylinders different from the one or some of the cylinders in accordance with a smaller one of a value obtained by adding a prescribed amount to a fuel increase rate that determines a last degree of richness and the fuel increase rate set through the increase rate setting process.

* * * * *